US010217624B2

(12) United States Patent
Qian

(10) Patent No.: US 10,217,624 B2
(45) Date of Patent: Feb. 26, 2019

(54) HIGH PAR MAINTENANCE RATE TYPE HIGH PRESSURE SODIUM LAMP WITH AUXILIARY STARTING SWITCH

(71) Applicant: Song Qian, Ontario, CA (US)

(72) Inventor: Song Qian, Ontario, CA (US)

(73) Assignee: Fanlight, Inc., Ontario, CA (US)

( * ) Notice: Subject to any disclaimer, the term of this patent is extended or adjusted under 35 U.S.C. 154(b) by 0 days.

(21) Appl. No.: 15/790,039

(22) Filed: Oct. 22, 2017

(65) Prior Publication Data

US 2018/0114688 A1 Apr. 26, 2018

(30) Foreign Application Priority Data

Oct. 24, 2016 (CN) ..... 201310923164.6

(51) Int. Cl.

| | |
|---|---|
| ***H01J 13/28*** | (2006.01) |
| ***H01J 17/22*** | (2012.01) |
| ***H01J 61/54*** | (2006.01) |
| ***H01J 61/30*** | (2006.01) |
| ***H01J 61/36*** | (2006.01) |
| ***H01J 61/82*** | (2006.01) |
| ***H05B 41/04*** | (2006.01) |
| ***H05B 41/06*** | (2006.01) |

(52) U.S. Cl.

CPC ..... *H01J 61/54* (2013.01); *H01J 61/302* (2013.01); *H01J 61/366* (2013.01); *H01J 61/825* (2013.01); *H05B 41/048* (2013.01); *H05B 41/06* (2013.01)

(58) Field of Classification Search

None

See application file for complete search history.

(56) References Cited

U.S. PATENT DOCUMENTS 5,079,479 A * 1/1992 Weske ..... H01J 61/544 313/25

* cited by examiner

*Primary Examiner* — Anh Tran

(74) *Attorney, Agent, or Firm* — Raymond Y. Chan; David and Raymond Patent Firm

(57) ABSTRACT

A high PAR maintenance rate type high pressure sodium lamp with an auxiliary starting switch is provided with an external glass tube and a discharge tube which is arranged at the center in the external glass tube and coaxial with the external glass tube. The surface of the discharge tube is provided with a metal lead. The left and right ends of an external glass shell are provided with pressure sealing plates which are fused and sealed through high temperature. The pressure sealing plates are internally provided with conductive sheets. One end of the discharge tube is connected with the conductive sheet of the left end through a left internal conductive support, and the other end is connected with the conductive sheet of the right end through an auxiliary starting switch component. According to the high pressure sodium lamp, the high pressure sodium lamp can be quickly lit up through a temperature controlled switch so that the high pressure sodium lamp has the advantages of being great in starting performance, great in lighting effect, high in stability, long in the service life, great in high temperature resistance and high pressure resistance and safe and reliable and is not liable to crack.

5 Claims, 4 Drawing Sheets

HIGH PAR MAINTENANCE RATE TYPE HIGH PRESSURE SODIUM LAMP WITH AUXILIARY STARTING SWITCH

CROSS REFERENCE OF RELATED APPLICATION

This is a non-provisional application that claims priority under 35 U.S.C. 119 to a Chinese application number 201610926164.6, filed Oct. 23, 2016. The afore-mentioned patent application is hereby incorporated by reference in its entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to lighting technology, and more particularly to a high PAR maintenance rate type high pressure sodium lamp with auxiliary starting switch.

Description of Related Arts

As the protected agriculture continuously develops, artificial light source has more often been utilized for supplemental lighting for the plants, so as to enhance the photosynthesis of the plants, which can achieve the objects of increasing production and shortening the vegetative cycle of the plants. Nowadays, it has been a very common phenomenon that high pressure sodium lamp is employed for plant lighting. In plant lighting, plants are very sensitive to the radiation spectrum of the wavelength range between 400-700 nm. Lights within this wavelength range are called photosynthetically available radiation, or PAR.

High pressure sodium lamp is a gas discharge lamp with the best luminous efficiency in HID light sources. In order to obtain a better lighting effect and longer service life for the high pressure sodium lamp, buffer gas, such as xenon, of higher pressure is inflated into the discharge tube. However, under a certain external condition, the higher the pressure of the buffer gas is, the higher impulse high voltage should be provided by the external circuit for the bulb to be lit up. When the high pressure sodium lamp starts, the ballast circuit provides an impulse high voltage of 1-5 KV to light up the lamp. In practical application, situation like the high pressure sodium lamp on some ballast circuit fails to be lit up happens.

In order to better fulfill the needs of agriculture lighting, it will need a greater firing pulse to start the lamp of such higher internal gas pressure. Therefore, it has to make a balance between the inflation pressure and well starting of the lamp in a practical production scenario. In order for the lamp to be lit up, it often has to reduce the inflation pressure of the inside of the arc tube, which will influence the agriculture lighting effect in certain extent. Besides, high pressure sodium lamps for agriculture lighting in domestic and foreign markets are commonly utilized with high-frequency electronic ballast. However, because types of electronic ballast are numerous and diverse, when the inside of the high pressure sodium lamp has been inflated with higher gas pressure, some of the electronic ballasts may have difficulty to start or even fail to start the lamp.

Moreover, when the high pressure sodium lamp is lit up, the discharge temperature in the discharge tube of the high pressure sodium lamp will gradually increase. The lamp will get into a stable functioning state in about 15 minutes, where parameters in all aspects are steady. At this moment, the axis temperature of the discharge tube of the high pressure sodium lamp is about 4500K, the tube wall temperature of the discharge tube is about 1500K, and the temperature between the discharge tube and the external blister is about 500-1500K. Therefore, if the selected material is poor in high temperature resistance, it may shorten the life-span of the high pressure sodium lamp.

SUMMARY OF THE PRESENT INVENTION

The technical issues that the present invention aims to solve comprise to overcome the deficiency of prior art to provide a high PAR maintenance rate type high pressure sodium lamp with auxiliary starting switch that can be rapidly lit up through a temperature controlled switch, and to have advantages of good starting performance, good lighting effect, great stability, long service life, and etc.

The technical solution that the present invention adopts for solving the technical issues comprises a high PAR maintenance rate type high pressure sodium lamp with auxiliary starting switch that comprises an external glass tube and a discharge tube arranged at the center of the inside of the external glass tube and coaxial with the external glass tube. The discharge tube comprises a metal lead arranged on the surface thereof. When buffer gas of higher pressure has been inflated into the discharge tube of the high pressure sodium lamp, it will have a metal lead printed on the discharge tube. When it is electrified, there will be capacitance-temperature characteristics formed between the electrode of the high pressure sodium lamp and the metal lead on the discharge tube, such that the discharge tube of the high pressure sodium lamp becomes easier to be lit up. Under the same external conditions, if the electric current that passes through the metal lead becomes greater, the high pressure sodium lamp can be started more easily. The left and right ends of the external glass shell are provided with pressure sealing plates which are fused and sealed through high temperature. The pressure sealing plates are internally provided with conductive sheets. An end of the discharge tube is connected with a conductive sheet of the left end through a left internal conductive support, and the other end is connected with a conductive sheet of the right end through an auxiliary starting switch component.

Further, the auxiliary starting switch component is an electromagnetic induction switch component or temperature controlled switch component.

Further, the electromagnetic induction switch component comprises an electromagnetic induction switch, a right internal conductive support, and a metal wrapping band. An end of the right internal conductive support is connected with the right conductive sheet of the outer glass shell, while another end thereof is connected with an end of the electromagnetic induction switch. Another end of the electromagnetic induction switch is connected with the metal wrapping band that is for auxiliary starting and is attached on the right end of the discharge tube.

Further, the electromagnetic induction switch comprises multiple sets of ceramic insulators that are arranged up and down in parallel and comprise a metal core bar respectively penetrated therein. Each set of the ceramic insulator comprises a coil coiled around on the surface thereof. The two ends of the metal core bar in the set of the ceramic insulator in the middle are respectively connected to the right side electrode of the discharge tube and the right side conductive sheet of the outer glass shell through corresponding right internal conductive support. The corresponding ends of the metal core bars respectively in the two up and down sets of the ceramic insulators are connected to the metal core bar in the middle through corresponding crossbeams by spot welding. The left ends of the three sets of coils are entwined and attached on the metal wrapping band that is for assisting starting and is attached on the right end of the discharge tube.

Further, the quantity of the ceramic insulator in the electromagnetic induction switch is at least two.

Further, the temperature controlled switch component comprises a temperature controlled switch, a right internal conductive support, a metal connecting rod, and a metal wrapping band. An end of the right internal conductive support is connected with the right conductive sheet of the outer glass shell, while another end thereof is connected with an end of the temperature controlled switch. Another end of the temperature controlled switch is connected with the metal wrapping band that is for auxiliary starting and is attached on the right end of the discharge tube.

Further, the temperature controlled switch comprises a left metal support and a right metal support. The left metal support comprises a left ceramic column riveted on an end thereof, while another end of the left metal support is connected with the right internal conductive support. The left metal support further comprises a dual metal discs affixed thereon through spot welding. The head end of the dual metal discs has a top metal contact arranged thereon.

The right metal support comprises a right ceramic column riveted on an end thereof and a bottom metal contact adapted to the top metal contact and arranged on the side of the right ceramic column. Another end of the right metal support is, through the metal connecting rod, connected with the metal wrapping band that is for auxiliary starting and is attached on the right end of the discharge tube.

The top metal contact and the bottom metal contact of the temperature controlled switch are in a closed state when the high pressure sodium lamp is not functioning, while after the high pressure sodium lamp has been lit up for 0.1 to 15 minutes, the top metal contact and the bottom metal contact are in a disconnected state.

Further, the discharge tube comprises two retaining brackets symmetrically arranged on the two ends thereof respectively.

Further, the conductive sheets on the two ends of the outer glass shell are respectively connected with the static wires through corresponding external conductive support sets. The static wire is formed by a plurality of metal wires entwined.

Further, the high pressure sodium lamp is a high PAR maintenance rate high pressure sodium lamp or double-ended high pressure sodium lamp.

Advantages of the present invention comprise the following:

1). the present invention allows the high pressure sodium lamp be reliably lit up by the ballast and the pressure of the buffer gas inside the discharge tube be further increased, so as to enhance the parameters in luminous efficiency, lumen maintenance, photosynthetic photon flux, and etc. of the high pressure sodium lamp. Besides, it can avoid failure of lighting for the high pressure sodium lamp on some ballast circuit when too much buffer gas has been inflated into the discharge tube of the high pressure sodium lamp.

2). The present invention has a feature of high temperature resistance. The temperature between the discharge tube and outer glass shell of the high pressure sodium lamp is about 500-1500K. The present invention can persistently and stably work under this working condition, which averts high temperature failure.

3). The present invention has an advantage of high pressure resistance. When the high pressure sodium lamp starts, the ballast circuit will provide an impulse high voltage of 1-5 KV that the present invention can avoid high pressure failure.

4). The present invention has an advantage of long life-span. After the high pressure sodium lamp is lit up, the discharge temperature in the discharge tube of the high pressure sodium lamp will gradually increase. The accumulative ambient temperature will suddenly trip off the temperature controlled switch in order to avoid it from constantly staying in the electrified onstate, such that the life-spans of the temperature controlled switch and the high pressure sodium lamp can be guaranteed.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

Here the present invention is further illustrated through referring to the drawings and embodiments.

DETAILED DESCRIPTION OF THE PREFERRED EMBODIMENT

Figure 1:
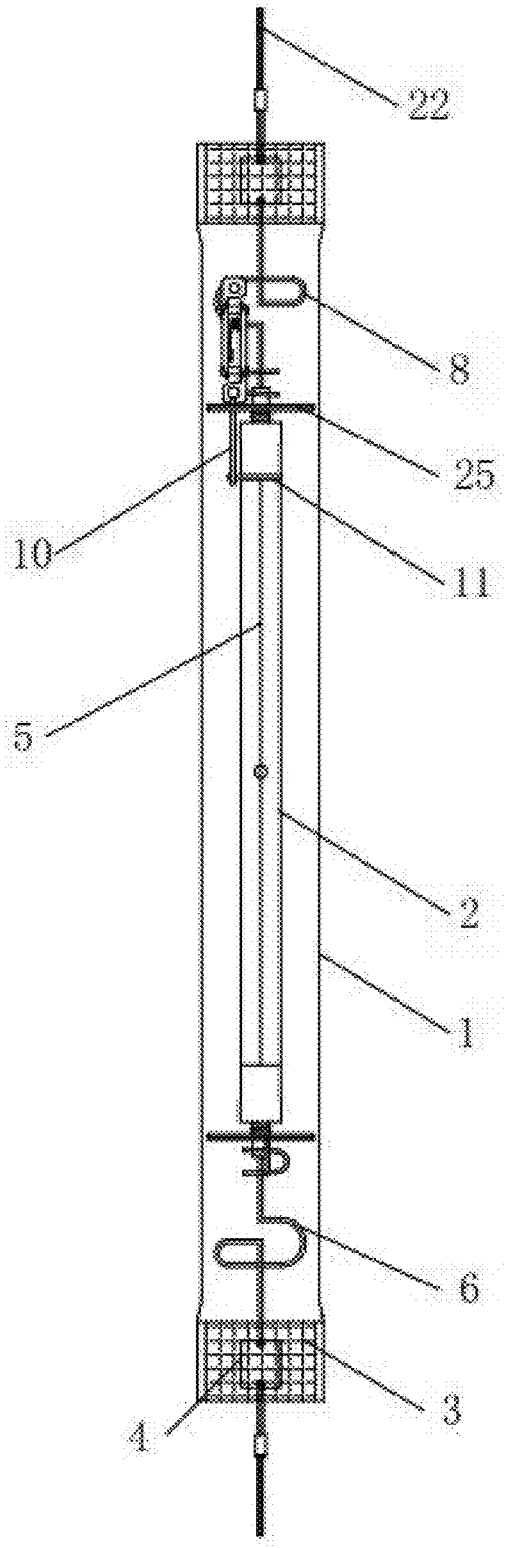
FIG. 1 is a structural perspective view of a first embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Here the present invention is further illustrated through referring to the appended figures and preferred embodiments. These figures are simplified perspective views that are only to illustrate basic structures of the present invention in a schematic manner. Therefore, they only demonstrate the constructions related to the present invention.

A high PAR maintenance rate type high pressure sodium lamp with auxiliary starting switch, as illustrated in FIGS. 1-4, comprises an external glass tube 1 and a discharge tube 2 arranged in a center of the external glass tube 1 and coaxially arranged to the external glass tube 1. The discharge tube 2 comprises a metal lead 5 arranged on the surface thereof. The outer glass shell 1 comprises a pressure sealing plate 3 on the left and right ends thereof respectively, which are fused and sealed through high temperature. Each pressure sealing plate 3 comprises a conductive sheet 4 arranged internally. An end of the discharge tube 2 is connected with the conductive sheet of the left end through a left internal conductive support 6, and the other end thereof is connected with the conductive sheet 4 of the right end through an auxiliary starting switch component.

The auxiliary starting switch component is an electromagnetic induction switch component or temperature controlled switch component.

The electromagnetic induction switch component comprises an electromagnetic induction switch, a right internal conductive support 8, and a metal wrapping band 11. An end of the right internal conductive support 8 is connected with the right conductive sheet 4 of the outer glass shell 1, while another end thereof is connected with an end of the electromagnetic induction switch. Another end of the electromagnetic induction switch is connected with the metal wrapping band 11 that is for auxiliary starting and is attached on the right end of the discharge tube 2.

The electromagnetic induction switch comprises multiple sets of ceramic insulators 13 that are arranged up and down in parallel and comprise a metal core bar 12 respectively penetrated therein. Each set of the ceramic insulator 13 comprises a coil 14 coiled around on the surface thereof. The two ends of the metal core bar 12 in the set of the ceramic insulator in the middle are respectively connected to the right side electrode of the discharge tube 2 and the right side conductive sheet 4 of the outer glass shell 1 through corresponding right internal conductive support 8. The corresponding ends of the metal core bars 12 respectively in the two up and down sets of the ceramic insulators 13 are connected to the metal core bar 12 in the middle through corresponding crossbeams 15 by spot welding. The left ends of the three sets of coils 14 are entwined and attached on the metal wrapping band 11 that is for reinforcing actuating and is attached on the right end of the discharge tube 2. The quantity of the ceramic insulator 13 in the electromagnetic induction switch is at least two.

The temperature controlled switch component comprises a temperature controlled switch, a right internal conductive support 8, a metal connecting rod 10, and a metal wrapping band 11. An end of the right internal conductive support 8 is connected with the right conductive sheet 4 of the outer glass shell 1, while another end thereof is connected with an end of the temperature controlled switch. Another end of the temperature controlled switch is connected with the metal wrapping band 11 that is for auxiliary starting and is attached on the right end of the discharge tube 2.

The electromagnetic induction switch comprises metal core bars 12 and ceramic insulators 13 respectively penetrated therein. Each set of the ceramic insulator comprises a coil 14 coiled around on the surface thereof. Each of the metal core bars is connected through the crossbeam by spot welding. An end of each of the coils is entwined to pass through the metal wrapping band 11 and to be connected to the metal lead 5 printed on the discharge tube 2. After the circuit is connected, starting circuit of the high pressure sodium lamp will generate alternating high-frequency impulse high voltage under the effect of the electric field. When the alternating current is converting the positive and negative half-wave, it will utilize the coil of the electromagnetic induction switch to store and release the energy. The electromagnetic induction switch will add the obtained energy onto the metal lead 11 printed on the discharge tube 2 through the metal wrapping band 11 that is for auxiliary starting, so as to help the electrode to reach the thermoelectric emission temperature earlier, such that the light can be successfully lit up.

The temperature controlled switch comprises a left metal support 16 and a right metal support 19. The left metal support 16 comprises a left ceramic column 17 riveted on an end thereof, while another end of the left metal support 16 is connected with the right internal conductive support 8. The left metal support 16 further comprises a dual metal discs 24 affixed thereon through spot welding. The head end of the dual metal discs 24 has a top metal contact 18 arranged thereon.

The right metal support 19 comprises a right ceramic column 20 riveted on an end thereof and a bottom metal contact 21 adapted to the top metal contact 18 and arranged on the side of the right ceramic column 20. Another end of the right metal support 19 is, through the metal connecting rod 10, connected with the metal wrapping band 11 that is for auxiliary starting and is attached on the right end of the discharge tube 2

The top metal contact 18 and the bottom metal contact 21 of the temperature controlled switch are in a closed state when the high pressure sodium lamp is not functioning, while after the high pressure sodium lamp has been lit up for 0.1 to 15 minutes, the top metal contact 18 and the bottom metal contact 21 are in a disconnected state.

The discharge tube 2 comprises two retaining brackets 25 symmetrically arranged on the two ends thereof respectively. The conductive sheets 4 on the two ends of the outer glass shell 1 are respectively connected with the static wires 22 through corresponding external conductive support set. The static wire 22 is formed by a plurality of metal wires entwined. The high pressure sodium lamp is a high PAR maintenance rate high pressure sodium lamp or double-ended high pressure sodium lamp.

First Embodiment

Figure 2:
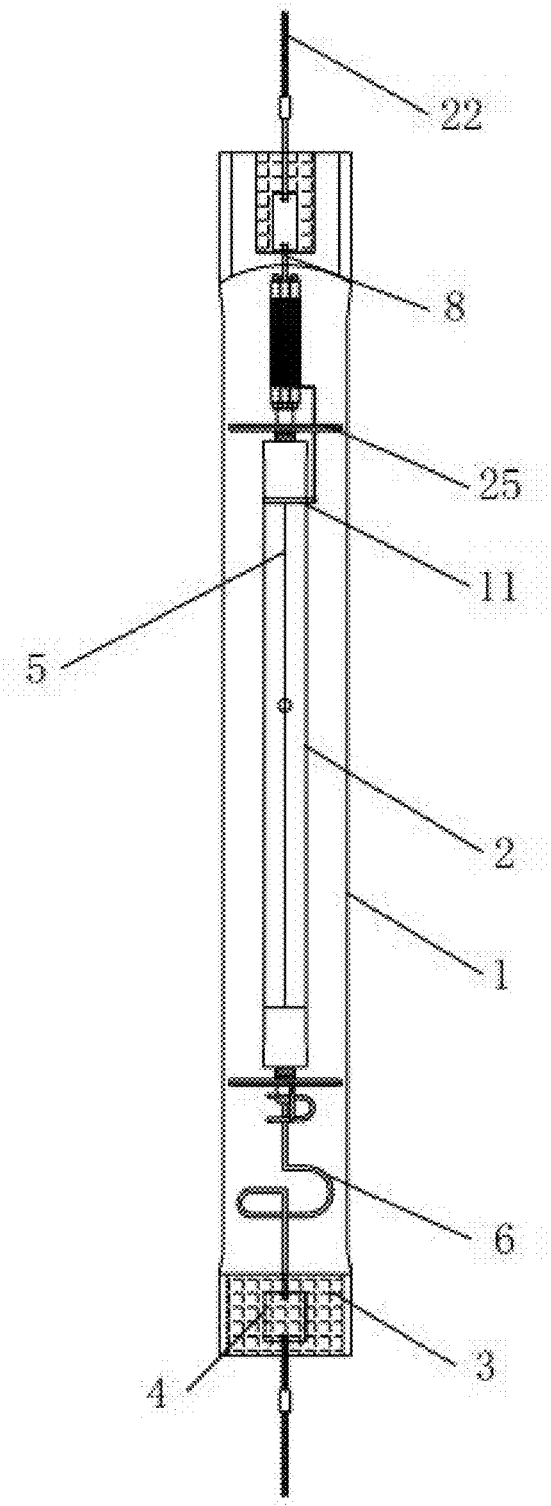
FIG. 2 is a structural perspective view of a second embodiment of the present invention.
Figure 3:
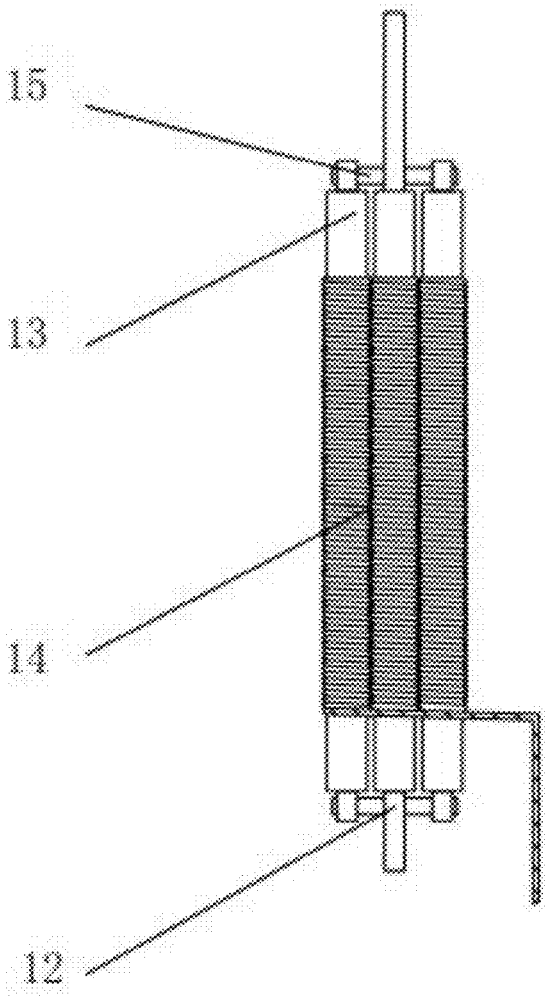
FIG. 3 is a structural perspective view of an electromagnetic induction switch in the present invention.

Referring to FIGS. 2 and 3, there are three sets of coil 14 coiled around on the ceramic insulators 13 respectively. Each ceramic insulator 13 has a metal core bar 12 penetrated therein. Each metal core bar 12 is remained insulated from each of the coils 14 by the ceramic insulator 13. The metal core bar 12 in the middle is electrically connected, while the other two metal core bars 12 on both sides are electrically connected through having the two ends thereof respectively be connected with two crossbeams 15 by spot welding. Also, the electric circuit passes through the metal wrapping band 11 that is for auxiliary starting, which reinforce the original induced current on the metal lead 5 printed on the discharge tube 2.

In the starting process, a kilovolt level alternating high-frequency impulse high voltage will pass through the metal core bar 12 of the ceramic insulator 13. When the current is converting its positive and negative half-waves, it will implement energy storage and releasing on the three coils 14 so as to assist starting.

After the light is lit up, the starting circuit will stop functioning. Then, the kilovolt level alternating high-frequency impulse high voltage will vanish. Therefore, the present system can avoid direct electrical connection of the electrode of the light, so as to prevent influence on light flux and even early termination of the life-span of the high pressure sodium lamp.

Second Embodiment

Figure 4:
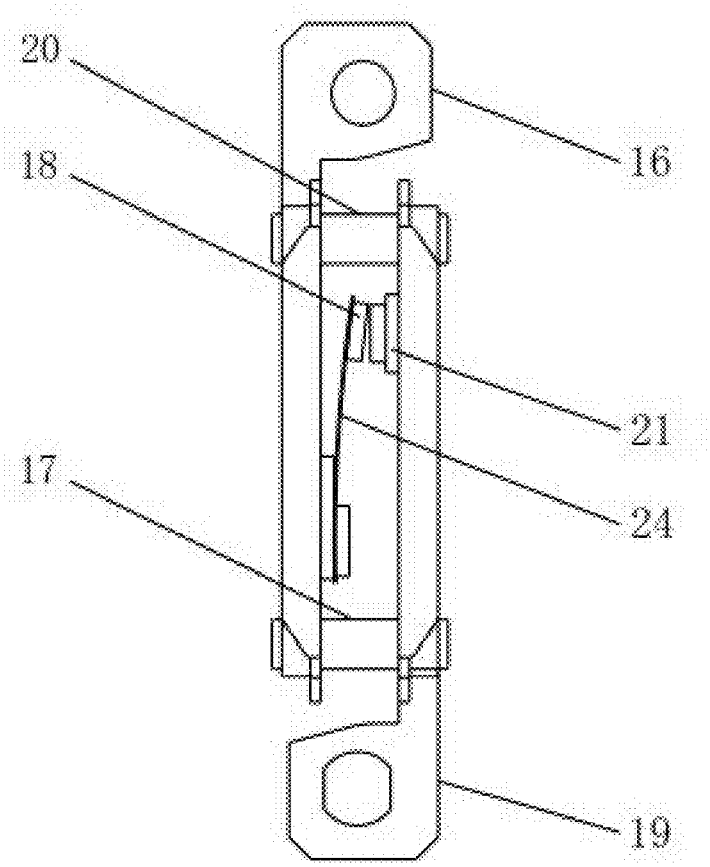
FIG. 4 is a structural perspective view of a temperature controlled switch in the present invention.

Referring to FIGS. 1 and 4, when the high pressure sodium lamp is not functioning, the temperature controlled switch will be in an onstate. When the high pressure sodium lamp is electrified through the ballast circuit, electric current will reach the metal lead 5 on the discharge tube 2 through the temperature controlled switch. Under the effect of electric field, the electric current generated by the metal lead 5 will further be increased. Then the buffer gas inside the high pressure sodium lamp 1 will rapidly be ionized and lit up. After the high pressure sodium lamp is lit up, its temperature will gradually increase. The accumulative ambient temperature will suddenly trip off the temperature controlled switch in order to avoid it from constantly staying in the electrified onstate, such that the life-spans of the temperature controlled switch and the high pressure sodium lamp can be guaranteed. The high pressure sodium lamp of the present invention can be quickly lit up through a temperature controlled switch and it has advantages of good starting performance, good lighting effect, great stability, long service life, etc.

The above embodiments are only for illustrating the technological constructs and features of the present invention, which aims to allow person skilled in the art to understand the content of the present invention and to be capable of implement the present invention, instead of to limit the extent of protection of the present invention. Those equivalents, changes or modifications based on the spiritual essence of the present invention shall all be within the extent of protection of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A high PAR maintenance rate type high pressure sodium lamp with auxiliary starting switch, comprising an external glass tube and a discharge tube arranged in said external glass tube, wherein said discharge tube comprises a metal lead arranged on a surface thereof, wherein said outer glass shell comprises at least two pressure sealing plates respectively on left and right ends thereof, which are fused and sealed through high temperature, wherein each of said pressure sealing plates comprises a conductive sheet arranged internally, wherein an end of said discharge tube is connected with said conductive sheet of the left end through a left internal conductive support, and the other end thereof is connected with said conductive sheet of the right end through an auxiliary starting switch component, wherein said auxiliary starting switch component is a electromagnetic induction switch component or a temperature controlled switch component, wherein said electromagnetic induction switch component comprises an electromagnetic induction switch, a right internal conductive support, and a metal wrapping band, wherein an end of said right internal conductive support is connected with the right said conductive sheet of said outer glass shell, while another end thereof is connected with an end of said electromagnetic induction switch, wherein another end of said electromagnetic induction switch is connected with said metal wrapping band that is for auxiliary starting and is attached on the right end of said discharge tube.

2. The high PAR maintenance rate type high pressure sodium lamp with auxiliary starting switch, as recited in claim 1, wherein said electromagnetic induction switch comprises multiple sets of ceramic insulators that are arranged up and down in parallel and comprise a metal core bar respectively penetrated therein, wherein each said set of said ceramic insulators comprises a coil coiled around on the surface thereof, wherein the two ends of said metal core bar in said set of said ceramic insulators in the middle are respectively connected to the right side electrode of said discharge tube and the right side conductive sheet of said outer glass shell through corresponding said right internal conductive support, wherein the corresponding ends of said metal core bars respectively in two up and down sets of said sets of said ceramic insulators are connected to said metal core bar in the middle through corresponding crossbeams by spot welding, wherein the left ends of said three sets of coils are entwined and attached on the metal wrapping band that is for reinforcing actuating and is attached on the right end of said discharge tube.

3. The high PAR maintenance rate type high pressure sodium lamp with auxiliary starting switch, as recited in claim 1, wherein a quantity of said ceramic insulator in said electromagnetic induction switch is at least two.

4. A high PAR maintenance rate type high pressure sodium lamp with auxiliary starting switch, comprising an external glass tube and a discharge tube arranged in said external glass tube, wherein said discharge tube comprises a metal lead arranged on a surface thereof, wherein said outer glass shell comprises at least two pressure sealing plates respectively on left and right ends thereof, which are fused and sealed through high temperature, wherein each of said pressure sealing plates comprises a conductive sheet arranged internally, wherein an end of said discharge tube is connected with said conductive sheet of the left end through a left internal conductive support, and the other end thereof is connected with said conductive sheet of the right end through an auxiliary starting switch component, wherein said auxiliary starting switch component is a electromagnetic induction switch component or a temperature controlled switch component, wherein said temperature controlled switch component comprises a temperature controlled switch, a right internal conductive support, a metal connecting rod, and a metal wrapping band, wherein an end of said right internal conductive support is connected with the right said conductive sheet of said outer glass shell, while another end thereof is connected with an end of said temperature controlled switch, wherein another end of said temperature controlled switch is, through said metal connecting rod, connected with said metal wrapping band that is for auxiliary starting and is attached on the right end of said discharge tube.

5. The high PAR maintenance rate type high pressure sodium lamp with auxiliary starting switch, as recited in claim 4, wherein said temperature controlled switch comprises a left metal support and a right metal support, wherein said left metal support comprises a left ceramic column riveted on an end thereof, wherein another end of said left metal support is connected with said right internal conductive support, wherein said left metal support further comprises a dual metal discs affixed thereon through spot welding, wherein the head end of said dual metal discs has a top metal contact arranged thereon, wherein said right metal support comprises a right ceramic column riveted on an end thereof and a bottom metal contact adapted to said top metal contact and arranged on the side of said right ceramic column, wherein another end of said right metal support is, through said metal connecting rod, connected with said metal wrapping band that is for auxiliary starting and is attached on the right end of said discharge tube, wherein said top metal contact and said bottom metal contact of said temperature controlled switch are in a closed state when said high pressure sodium lamp is not functioning, while after said high pressure sodium lamp has been lit up for 0.1 to 15 minutes, said top metal contact and said bottom metal contact are in a disconnected state.

* * * * *